US005623760A

United States Patent [19]

Newham

[11] Patent Number: 5,623,760

[45] Date of Patent: Apr. 29, 1997

[54] PRESSURE SENSITIVE SWITCH

[75] Inventor: Paul F. Newham, San Antonio, Tex.

[73] Assignee: Bed-Check Corporation, Tulsa, Okla.

[21] Appl. No.: 706,744

[22] Filed: Sep. 9, 1996

Related U.S. Application Data

[63] Continuation of Ser. No. 281,431, Jul. 27, 1994, Pat. No. 5,554,835.

[51] Int. Cl.[6] ..... H01H 3/14; H01H 11/04

[52] U.S. Cl. ..... 29/622; 200/86 R

[58] Field of Search ..... 307/119, 147, 307/148; 340/933, 940, 665–667; 73/146; 200/85 R, 85 A, 86 R, 512, 514, 278, 292; 156/269; 428/901; 29/592.1, 622, 830, 469, 846; 427/96

[56] References Cited

U.S. PATENT DOCUMENTS

| | | | |
|---|---|---|---|
| 3,812,313 | 5/1974 | Wolf | 200/85 A |
| 3,866,335 | 2/1975 | Hendricks | 200/1 R |
| 4,154,178 | 5/1979 | Brown | 112/158 E |
| 4,484,043 | 11/1984 | Musick | 200/85 R |
| 4,539,445 | 9/1985 | Jabben | 200/5 A |
| 4,565,910 | 1/1986 | Musick | 200/85 R |
| 4,621,178 | 11/1986 | Taguchi | 219/10.55 B |
| 4,773,155 | 9/1988 | Buchien | 29/622 |
| 5,047,602 | 9/1991 | Lipka | 200/86 R |

*Primary Examiner*—Gerald P. Tolin

*Attorney, Agent, or Firm*—Frank J. Catalano; Scott R. Zingerman

[57] ABSTRACT

A pressure sensitive switch has upper, middle and lower laminar elongated members, the middle member having an opening therethrough defining a cavity between the upper and lower members. A first array of substantially parallel, spaced-apart electrically conductive bands is fixed to a lower surface of the upper member and traverses the cavity. A second array of substantially parallel, spaced-apart electrically conductive bands is fixed to an upper surface of the lower member and traverses the cavity and the upper member bands, selected lower member bands being discretely connected to an electrical input lead and other lower member bands being discretely connected to an electrical output lead. An array of substantially parallel, spaced-apart dielectric bands narrower than the conductive bands is fixed to the lower member upper surface and traverses the cavity between the arrays of conductive bands at alternate overlapping points thereof and partially separates the arrays of conductive bands from electrical contact therebetween at said alternate overlapping points. The upper and lower members are resiliently flexible to permit the overlapping points of the arrays of conductive bands to close into and open out of electrical contact therebetween upon exertion and removal, respectively, of a threshold external compressive force to the cavity.

4 Claims, 3 Drawing Sheets

PRESSURE SENSITIVE SWITCH

This is a continuation of application Ser. No. 08/281,431 filed on Jul. 27, 1994 now U.S. Pat. No. 5,554,835.

BACKGROUND OF THE INVENTION

This invention relates generally to pressure sensitive switches and more particularly concerns switches for the detection of the presence or absence of a person from a hospital bed, wheelchair, baby carriage or any other body supporting structure with respect to which it may be useful to determine the status of occupancy, and to the method of making such switches.

Pressure sensitive switches presently used in many hospital facilities are disclosed in previously issued U.S. Pat. Nos. 4,484,043 and 4,565,910. In these known devices, broad bands of conductive material are used in upper and lower layers such that contact of any portion of the broad upper band with any portion of the broad lower band will complete a circuit between input and output conductors connected to the bands.

While these switches work quite effectively, they are somewhat difficult of manufacture in a manner providing consistency and predictability of operation and consequently are sufficiently expensive to limit their broad use as single use disposable devices. Furthermore, while they work quite well in sensing the presence or absence of fully grown adults, as lesser weights are applied to the switch, sensing reliability somewhat diminishes. The problem of providing a switch having reliable characteristics over a broad weight range is complicated by the requirement that the switch must not only reliably close upon the application of a minimal threshold weight, but must also reliably return to its open condition upon the removal of that threshold weight. In present devices, weights resulting in at least 50 to 75 psi are necessary to achieve desired levels of reliability. In addition, known devices are of relatively thick profile and stiffness so as to provide adequate separation of the conductive bands. This results in a diminishing of patient or occupant comfort and also in a diminishing of the impact of pressure on its operation, contact more frequently being achieved by a crimping or kinking of the device than by flex due to pressure. And known devices are not completely sealed and, therefore, do not provide a fluid or water impervious device, thus compromising the device's integrity and consistency of operation. It is therefore an object of this invention to provide a pressure sensitive switch which will reliably close at relatively low threshold pressures. It is also an object of this invention to provide a pressure sensitive switch which will reliably open on release of the threshold pressure from the switch. It is further an object of this invention to provide a pressure sensitive switch having gridded conductive surfaces with a limited matrix of contact points so as to minimize the possibility of circuit completion in the absence of a relatively low threshold pressure. It is similarly an object of this invention to provide a pressure sensitive switch having gridded conductive surfaces with a limited matrix of contact points separated by a gridded dielectric to minimize the possibility of circuit completion upon release of the threshold pressure. Another object of the invention is to provide a pressure sensitive switch that lends itself to ease in mass production with minimal impact on predictability and consistency in switch operation. A further object of this invention is to provide a pressure sensitive switch of relatively thin and flexible profile so as to maximize patient comfort and to minimize the possibility of crimping or kinking and resultant inadvertent contact. And it is an object of this invention to provide a pressure sensitive switch which is impervious to water and other fluids.

SUMMARY OF THE INVENTION

In accordance with the invention, a pressure sensitive switch is provided having upper, middle and lower laminar elongated members. The middle member has one or more openings which define one or more cavities between the upper and lower members. A first array of substantially parallel, spaced-apart electrically conductive bands is fixed to a lower surface of the upper member and traverses the cavities. A second array of substantially parallel, spaced-apart electrically conductive bands is fixed to an upper surface of the lower member and traverses the cavities and the upper member bands. Selected lower member bands are discretely connected to an electrical input lead and the other lower member bands are discretely connected to an electrical output lead. An array of substantially parallel, spaced-apart dielectric bands is fixed to the lower member upper surface and traverses the cavities between the first and second arrays of conductive bands at their alternate overlapping points, separating the first and second arrays of conductive bands from making electrical contact with each other in the area of overlap with the dielectric bands. The upper and lower members are so resiliently flexible as to permit the overlapping points of the arrays of conductive bands to close into or open out of electrical contact, except in the area of overlap with the dielectric bands, upon exertion or removal, respectively, of a threshold external compressive force to or from the cavities. Preferably, the upper member array is orthogonal to the lower member array and the bands of the upper and lower member arrays have centerlines substantially equally spaced. In this arrangement, the overlapping of the centerlines of the conductive arrays defines a matrix of squares. Preferably, the bands of dielectric have one edge along the diagonal of alternate ones of the squares and cover one half of the overlapping portion of the conductive bands The conductive bands are of substantially equal width and the dielectric bands are of substantially equal width and narrower than the conductive bands and preferably one half the diagonal of the area of the overlapping conductive bands so that, even at those overlap points partially separated by dielectric, electrical contact is possible. Such a metricized arrangement has been found to provide most suitable complements of ease of manufacture and, consistency of operation. Preferably, the laminar members are of heat stabilized polyester and the conductive bands are formed of a conductive ink, such as a blend of graphite/silver ink, screened onto the members.

In making the pressure sensitive switch, one array of substantially parallel, spaced-apart electrically conductive bands is applied to the surface of the upper flat flexible member. Another array of substantially parallel, spaced-apart electrically conductive bands is applied to the surface of the lower flat flexible member. This array includes a conductive input lead connected to selected ones of the conductive bands and a conductive output lead connected to the other conductive bands. An array of substantially parallel, spaced-apart dielectric bands are also applied to the surface of the lower member and to the lower member conductive bands. One or more openings are cut through the middle flat flexible member. The upper, middle and lower members are laminated together with the conductive arrays traversing the openings and each other and the dielectric array diagonally aligned with alternate overlapping points of the conductive arrays and separating the conductive arrays from making electrical contact in the area of dielectric overlap.

The thickness of the members and the spacing of the bands of the arrays is such that the upper and lower members resiliently flexibly permit the overlapping points of the arrays of conductive bands except in the area of overlap by the dielectric, to close into or open out of electrical contact upon exertion or removal, respectively, of the threshold external compressive force to or from the openings. Preferably the conductive and dielectric bands are formed by screen painting conductive and dielectric ink, respectively, on the member, and lamination is accomplished by heat sealing or adhesive bonding of the polyester members together.

BRIEF DESCRIPTION OF THE DRAWINGS

Other objects and advantages of the invention will become apparent upon reading the following details description and upon reference to the drawings in which.

While the invention will be described in connection with a preferred embodiment and method, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
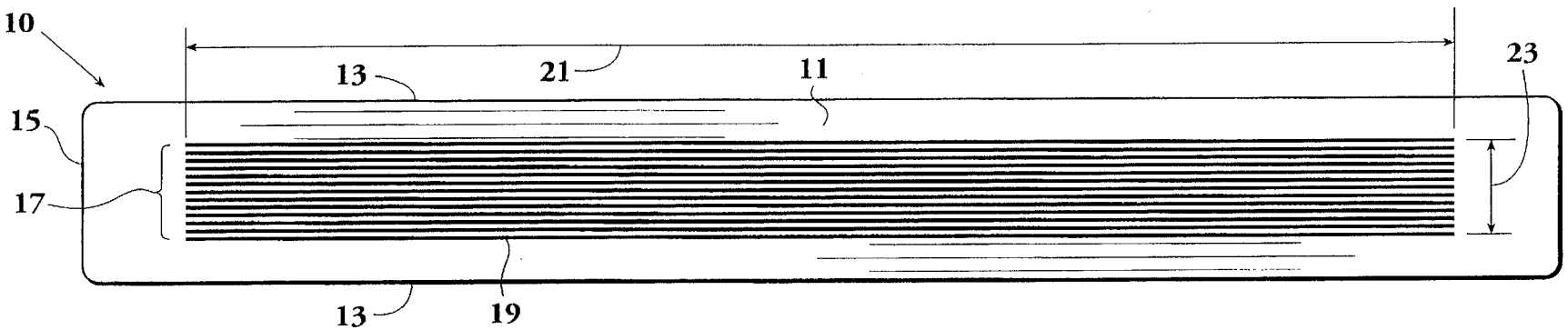
FIG. 1 is a bottom plan view of a preferred embodiment of the upper member of the pressure sensitive switch with a conductive grid applied thereon.

Turning to FIG. 1, a preferred embodiment of an upper member of a pressure sensitive switch is illustrated. As shown, the upper member 10 consists of a flat, elongated, substantially rectangular sheet 11 having lengthwise edges 13 considerably longer than its widthwise edges 15. An array 17 of conductive bands 19 extends substantially longitudinally on the bottom face of the sheet 11. Preferably, the conductive bands 19 are parallel, of equal width and aligned on equally spaced centers. The array 17 extends substantially across the interior portion of the bottom face of the sheet 11, the length 21 and width 23 of the array 17 leaving a relatively wide perimeter portion of the bottom surface without any conductive grid. Preferably, the array 17 of conductive bands 19 will be applied by screen painting a conductive ink on the bottom surface of the upper member 11.

Figure 2:
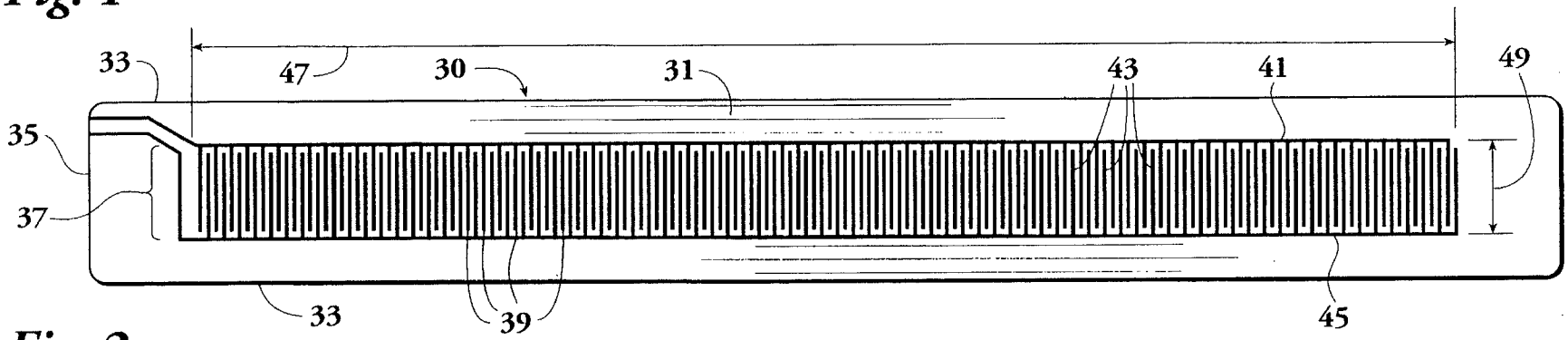
FIG. 2 is a top plan view of a preferred embodiment of the lower member of the pressure sensitive switch with the input and output conductive grid applied thereon.

As shown in FIG. 2, a preferred embodiment of the lower member 30 of the pressure sensitive switch also consists of a flat, elongated, substantially rectangular sheet 31, preferably of length 33 and width 35 substantially equal to the length 13 and the width 15 of the upper member 10. An array 37 of conductive bands is applied to the top surface of the lower member 30, the width of each of the bands of the array 37 preferably being of equal width with each other and to the conductive bands 19 of the upper member 10. As shown, the lower member array 37 is preferably arranged in a widthwise grid orthogonal to the upper member conductive array 17 on center lines preferably equally displaced as the center lines of the conductive bands 19 of the upper member 10. Preferably, alternate ones 39 of the lower member conductive array 37 are discreetly connected to an electrically conductive input lead 41 while the other bands 43 of the lower member conductive array 37 are discretely connected to an electrically conductive output lead 45. Also preferably, the length 47 and width 49 of the array 37 is substantially the same as the length 21 and width 23 of the upper member array 19.

Figure 3:
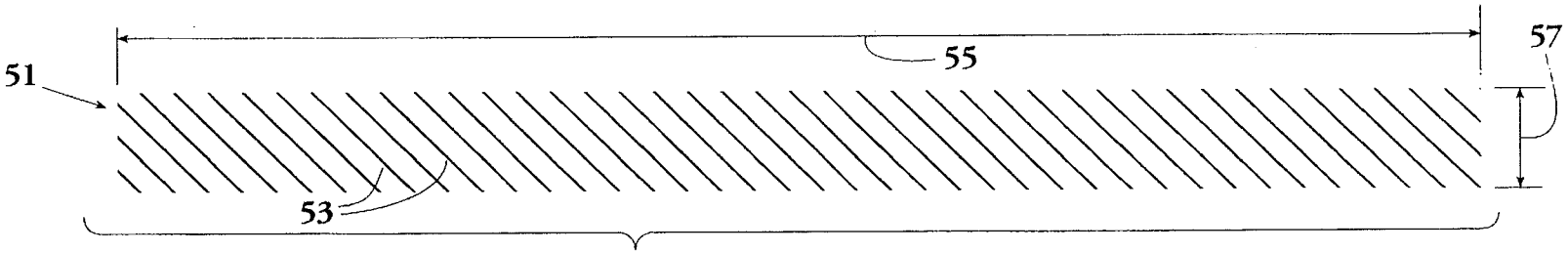
FIG. 3 is a bottom plan view of a preferred embodiment of the dielectric grid to be applied over the conductive grid and the member illustrated in FIG. 2.

Looking now to FIG. 3, a preferred embodiment of a dielectric grid 51 to be applied over the array 37 of conductive bands 39 and 43 on the lower sheet 31 is illustrated. As shown, the dielectric grid 51 preferably consists of a plurality substantially parallel and equally spaced apart bands 53 of dielectric material arranged in a fashion such that each of the dielectric bands 53 will traverse all of the conductive bands 39 and 43 when the dielectric grid 51 is applied to the lower sheet 31 and the array 37 of conductive bands 39 and 43. As shown, and for reasons which will hereinafter become apparent, the bands 53 are preferably aligned in a 45° angular relationship with respect to the widthwise conductive bands 39 and 43. The length 55 and width 57 of the dielectric grid 51 is substantially equal to the length 47 and width 49 of the conductive array 37. The width of each dielectric band 53 is less than the width of the conductive bands 19, 39 and 43 and preferably one half the diagonal of the overlapping area of the conductive bands 19, 39 and 43.

Figure 4:
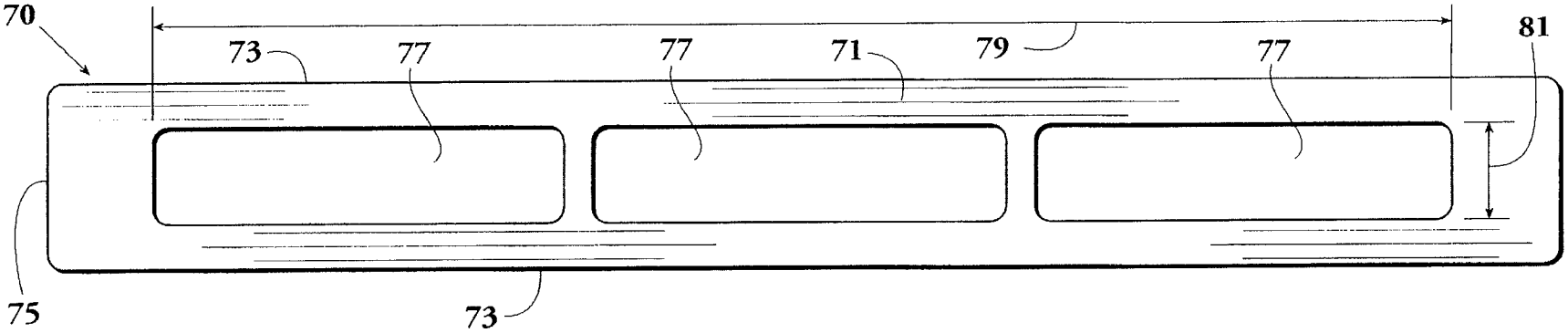
FIG. 4 is a reversible plan view of a preferred embodiment of the middle member of the pressure sensitive switch.

Turning now to FIG. 4, a preferred embodiment of a middle member of the pressure sensitive switch is illustrated. As shown, the middle member 70 consists of a flat, elongated, substantially rectangular sheet 71, preferably of length 73 and width 75 identical to the lengths 13 and 33 and widths 15 and 35 of the upper and lower sheets 11 and 31. One or more openings 77, are provided through the middle member 71. The openings 77 are substantially rectangular and arranged in longitudinal alignment across the middle member 70. The total length 79 of the openings 77 is substantially equal to the lengths 55 of the dielectric grid 51 or the lengths 21 and 47 of the arrays 17 and 37 of upper and lower member conductive bands 19, 39 and 43. Similarly, the width 81 of the openings 77 is substantially equal to the width 57 of the. dielectric grid 51 and the widths 23 and 49 of the arrays 17 and 37 of upper and lower member conductive bands 19, 39 and 43.

Figure 5:
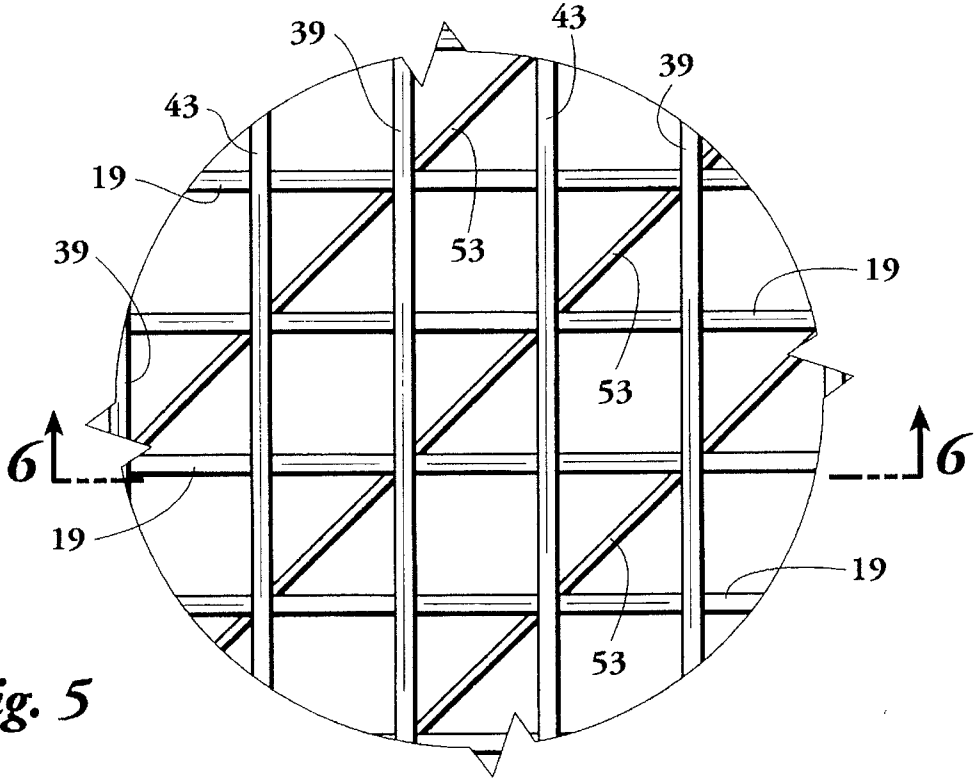
FIG. 5 is an exploded plan view of a preferred embodiment of the pressure sensitive switch illustrating the matrix arrangement of the conductive and dielectric grids.
Figure 6:
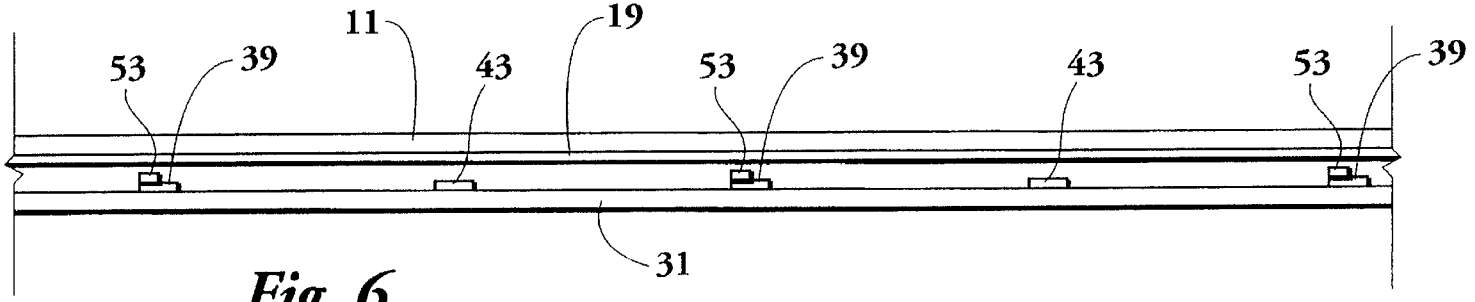
FIG. 6 is a sectional view taken along the line 6—6 of FIG. 5.

Looking at FIGS. 5 and 6, the relative alignments of the upper member conductive bands 19, the dielectric bands 53 and the input and output conductive bands 39 and 43 when the upper, middle and lower members 10, 70 and 30 are laminarly arranged is shown. In the segment of this arrangement shown, the conductive bands 19, the dielectric bands 53 and the input and output bands 39 and 43 are traversing one of the openings 77 in the middle member 78. As shown, the upper conductive bands 19 and lower conductive bands 39 and 43 form a matrix of squares while the dielectric bands 53 intersect alternate squares in a diagonal direction. Thus alternate overlapping portions of the wider upper and lower conductive bands 19, 39 and 43 are partially separated from the possibility of electrical contact therebetween by the narrower dielectric bands 53, as can best be seen in FIG. 6. Consequently, in the preferred arrangement, only fifty percent of the matrix of overlapping points can come into full electrical contact and the remaining overlapping points can achieve electrical contact over a maximum of 50 percent of their overlapping area.

This uniform distribution of full and partial contact points in spaced apart relationship affords the control necessary to assure that appropriate applications of threshold pressure to the cavity portions of the switch will consistently cause completion of the switching circuit and also that removal of or lack of such an appropriate threshold pressure will reliably cause the circuit not to be complete.

Figure 7:
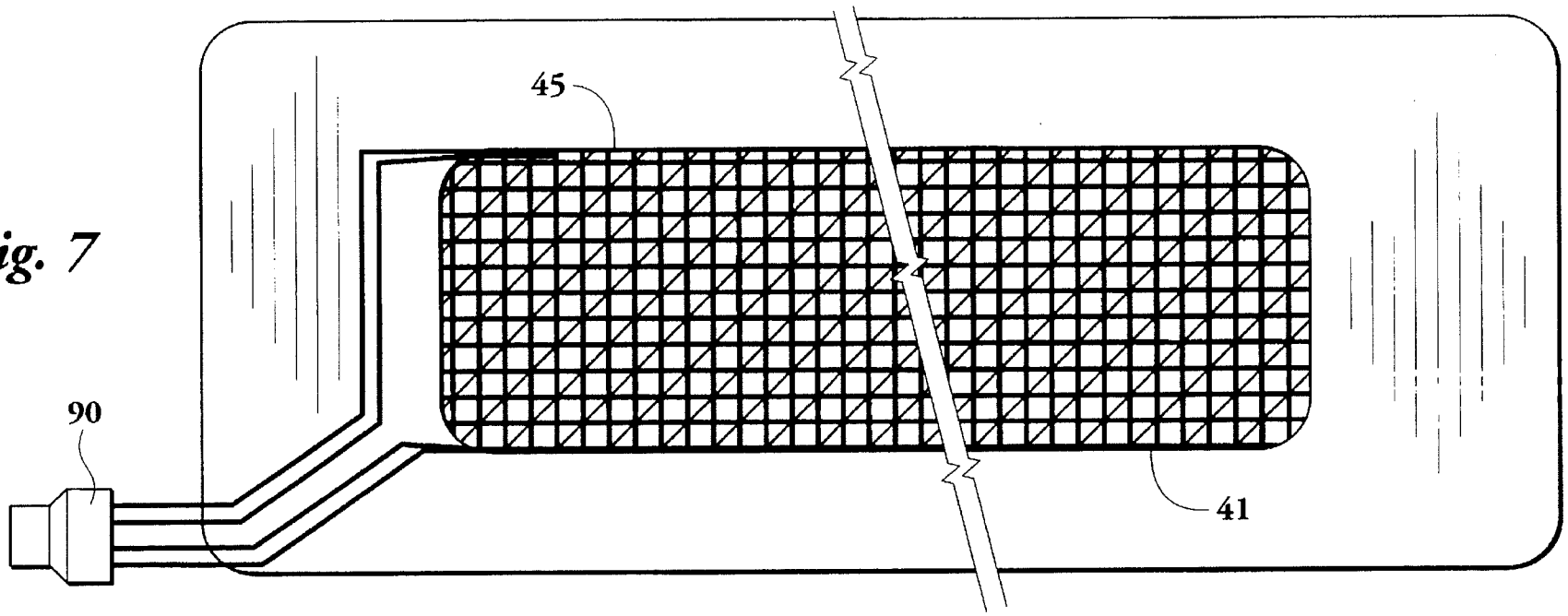
FIG. 7 is a bottom plan view of a preferred embodiment of the pressure sensitive switch.

In making the pressure sensitive switch, the conductive grids are screen painted onto their respective members. Preferably, the upper and lower members 10 and 30 will be 5 mil heat stabilized polyester and the conductive bands 19, 39 and 43 will be formed by use of a suitable conductive ink such as 50/50 graphite/silver blend. The input and output leads 41 and 45 of the lower member conductive bands 39 and 43 are screen painted simultaneously with the conductive bands 39 and 43. After the conductive ink has been screened onto the lower sheets 31, a dielectric ink can be used to screen the dielectric array 51 over the lower member conductive array 37. Preferably, a plurality of arrays 37 can be screened onto a single sheet which can then be cut into a number of sheets 31. The openings 77 are die cut into the middle member 70 which will preferably be formed of 10 mil sheet such as a 7 mil polyester film with a 1 ½mil adhesive on each side thereof if adhesive bonding is used to accomplish lamination. The upper, middle and lower members 10, 70 and 30 are then laminated together, as by heat sealing or adhesively bonding the middle member 70 between the upper and lower members 10 and 30. FIG. 7 illustrates the upper member 10 of FIG. 1 and the lower member 30 of FIG. 2 with the dielectric array 51 of FIG. 3 superimposed thereon laminated to the middle member 70 of FIG. 3 using a clear polyester for the upper, middle and lower members 10, 70 and 30. The polyester need not necessarily be clear. As shown, the input lead 41 and the output lead 45 are extended externally of the switch to a plug 90 for connection of the switch to an appropriate electrical power and control unit (not shown).

The device as shown is in an elongated rectangular configuration with conductive arrays 17 and 37 in orthogonal arrangement and dielectric array 51 intersecting the orthogonal conductive arrays 17 and 37 at alternate diagonals. However, while this arrangement is preferred, it is not necessary that the conductive arrays 17 and 37 be in orthogonal relationship to each other or that they be on equally spaced centers. Depending on the particular application involved, it is necessary only that a limited matrix of full and partial contact points be established so as to provide the consistency of operation desired for given threshold pressures. It has been found that, for operation at a desired threshold pressure of approximately 2 pounds per square inch, a switch approximately 3.5 inches wide by 29 inches long with 5 mil heat stabilized polyester upper and lower members 10 and 30 and a 10 mil polyester middle member 70 with three openings 77 each 2 inches by 8 inches and spaced ½inch apart and inset 2 inches from the ends of the device and ¾inches from the sides of the device is a very workable structure. In this arrangement, upper and lower member conductive grid bands 19, 39 and 43 of 0.09 inches on 0.18 inch centers with 0.06 inch wide dielectric bands 53 on 0.26 inch centers using 50/50 graphic/silver blend conductive ink for the conductive bands 19, 39 and 43 is an optimum arrangement.

Thus, it is apparent that there has been provided, in accordance with the invention, a pressure sensitive switch and method for making the switch that fully satisfies the objects, aims and advantages set forth above. While the invention has been described in conjunction with specific embodiments and methods, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A method of making a pressure sensitive switch comprising the steps of:

applying an array of substantially parallel, spaced-apart electrically conductive bands to a surface of a first flat flexible member;

applying an array of substantially parallel, spaced-apart electrically conductive bands to a surface of a second flat flexible member, said array including a conductive input lead connected to selected ones of said second member conductive bands and a conductive output lead connected to others of said second member conductive bands;

applying an array of substantially parallel, spaced-apart dielectric bands narrower than said conductive bands to said surface of said second member and traversing said first member conductive bands;

cutting an opening through a third flat flexible member;

laminating said first, second and third members together with said conductive arrays traversing said opening and each other and said dielectric array being diagonally aligned with alternate overlapping points of said conductive arrays and partially separating said conductive arrays from electrical contact therebetween at said alternate overlapping points;

whereby said upper and lower members resiliently flexibly permit said overlapping points of said arrays of conductive bands to close into and open out of electrical contact therebetween upon exertion and removal, respectively, of a threshold external compressive force to and from said opening.

2. A method according to claim 1, said steps of applying conductive bands comprising screen painting conductive ink.

3. A method according to claim 1, said step of applying dielectric bands comprising screen painting dielectric ink.

4. A method according to claim 1, said step of laminating comprising heat sealing said members together.

* * * * *